US006755063B2

(12) United States Patent
Takadama

(10) Patent No.: US 6,755,063 B2
(45) Date of Patent: Jun. 29, 2004

(54) SIDE BAR TYPE CYLINDER LOCK WITH VARIABLE KEY CODE

(75) Inventor: Osamu Takadama, Tokyo (JP)

(73) Assignee: Takigen Manufacturing Co. Ltd., Tokyo (JP)

( * ) Notice: Subject to any disclaimer, the term of this patent is extended or adjusted under 35 U.S.C. 154(b) by 0 days.

(21) Appl. No.: 10/357,915

(22) Filed: Feb. 4, 2003

(65) Prior Publication Data

US 2004/0069030 A1 Apr. 15, 2004

(30) Foreign Application Priority Data

Oct. 15, 2002 (JP) ..... 2002/300965

(51) Int. Cl.[7] ..... E05B 27/00

(52) U.S. Cl. ..... 70/495; 70/492; 70/383; 70/384

(58) Field of Search ..... 70/492–495, 377, 70/382–385

(56) References Cited

U.S. PATENT DOCUMENTS 3,722,241 A * 3/1973 Sussina ..... 70/364 R
3,990,282 A * 11/1976 Sorum ..... 70/364
3,999,413 A * 12/1976 Raymond et al. ..... 70/364 R
4,376,382 A * 3/1983 Raymond et al. ..... 70/338
4,404,824 A * 9/1983 Hennessy ..... 70/364 A
4,750,342 A * 6/1988 Nakai ..... 70/364 R
4,942,749 A * 7/1990 Rabinow ..... 70/495
4,966,021 A * 10/1990 Boag ..... 70/383
6,119,495 A * 9/2000 Loreti ..... 70/495 X
2003/0089149 A1 * 5/2003 Suzuki et al. ..... 70/492
2003/0154753 A1 * 8/2003 Dimig et al. ..... 70/495

* cited by examiner

*Primary Examiner*—Suzanne Dino Barrett
(74) *Attorney, Agent, or Firm*—Martin Smolowitz

(57) ABSTRACT

In a side bar cylinder lock with a variable key code, plug (6) engages within casing (1) at two opposite portions in preventing plug (6) from rotating in locking state. This improves the lock in resistance to attack. Plug (6) has holes (8) each receiving a tumbler plate (11) and variable tumbler (14) side by side therein. When plug (6) is rotated to have a bulged portion (21) of said bar holder (19) abut against concave portion (2) of casing (1), spring (25) forces end portion (26) of plate (11) to enter receiving hole (9) of plug (6), and forces a bulged portion (21) of holder (19) to engage with concave portion (2) of casing (1), whereby engaging portion (13) of plate (11) is disengaged from an engaged portion (15) of variable tumbler (14). After such disengagement, variable tumbler (14) is rotated through an angle to change the key code to a new one.

5 Claims, 5 Drawing Sheets

SIDE BAR TYPE CYLINDER LOCK WITH VARIABLE KEY CODE

BACKGROUND OF THE INVENTION

1. Field of the Invention

The present invention relates to a side bar type cylinder lock with a variable key code.

2. Description of the Related Art

When a key of a cylinder lock mounted on a door of a room or of instruments each placed under the control of individual owner, to which key a predetermined key code is allotted, is stolen or lost, or when an employee who knows such a predetermined key code retires from the service, there is a certain risk that a person or ex-employee, who steals or obtains the key itself as his finding or as a key's replica produced by himself or herself on the basis of the key code, may illegally use the key or key's replica in unlocking the cylinder lock of the room or of the instruments. In order to lessen the risk of such illegal use of the key or key code by the person or ex-employee, it is necessary to replace an assembly of the cylinder lock and its key with a new assembly or set of cylinder lock and its key, to which assembly another key code is allotted.

However, it is very cumbersome and expensive to replace the cylinder lock having heretofore been used with such a new set, since the cylinder lock to be replaced is mounted on the door of the room or of the instruments each placed under the control of the individual owner. In order to solve this cumbersome and expensive problem of replacement of the cylinder lock, there is provided a conventional side bar type cylinder lock capable of enjoying a variable key code. For example, such a conventional side bar type cylinder lock is disclosed in Japanese Patent application Laid-Open No. Hei 7-197705.

This conventional cylinder lock comprises:

a sleeve-like casing provided, in its inner peripheral surface, with both a side bar receiving concave portion and a retractor receiving concave portion;

a plug rotatably mounted in the sleeve-like casing, wherein the plug is provided with: a keyhole; a reset-key insertion hole; a plurality of tumbler insertion holes each crossing the keyhole; a side bar receiving hole provided in one of opposite ends of each of the tumbler insertion holes; and, a retractor receiving hole provided in the other of the opposite ends of each of the tumbler receiving holes;

a plurality of tumbler plates each slidably received in the tumbler insertion hole, wherein the tumbler plate is provided with a side bar engaging concave portion in one of opposite sides thereof and a saw-toothed engaging portion in the other of the opposite sides;

a plurality of variable tumblers each slidably received in the tumbler insertion hole, wherein: the variable tumbler is provided with a saw-toothed engaged portion in one of its opposite sides and has the saw-toothed engaged portion detachably engaged with the engaging portion of the tumbler plate; and, the variable tumbler is further provided with a key insertion groove which is communicated with the keyhole;

a retractor slidably mounted in the retractor receiving hole, wherein the retractor is provided with: a plurality of guide portions each adapted to guide the variable tumbler into the tumbler insertion hole in parallel to the tumbler insertion hole; and, a reset-key insertion passing hole, wherein the retractor has one of its opposite sides engaged with a key inserted into the key insertion groove and has the other of the opposite sides formed into an engaging projection which is detachably engaged with the retractor receiving concave portion of the sleeve-like casing;

a side bar slidably received in the side bar receiving concave portion of the plug, wherein the side bar has its front end resiliently biased toward the side bar receiving concave portion of the plug in such a manner such that: the front end of the side bar is received in the side bar receiving concave portion of the plug; and, when the side bar is moved in a direction opposite to its biased direction, the side bar has its rear end detachably engaged with side bar engaging concave portion of the tumbler plate; and a reset key, wherein, when the reset key is inserted into both the reset-key insertion hole of the plug and the reset-key insertion/passing hole of the retractor and rotatably driven therein, the reset key pushes the engaging projection of the retractor in a manner such that the engaging projection of the retractor is forcibly inserted into the retractor receiving concave portion of the sleeve-like casing.

In the conventional cylinder lock with the variable key code having the above construction: since the reset-key insertion hole for driving the retractor is formed in a front surface of the plug in addition to the ordinary keyhole, the conventional cylinder lock with the variable key code is quite different in appearance from the ordinary cylinder lock of a single-keyhole type due to the presence of the reset-key insertion hole. As a result, the conventional cylinder lock with the variable key code tends to enhance tampering of the reset-key insertion hole by an unauthorized person. For example, such an unauthorized person often fills up the reset-key insertion hole with foreign matter, which often makes it impossible for an authorized person or user to change the key code of the conventional cylinder lock. Further, in changing the key code of the conventional cylinder lock, it is difficult for the user to operate the reset key due to interference from the key inserted into the ordinary keyhole which is closest in vicinity to the reset-key insertion hole. Consequently, the conventional cylinder lock with the variable key code is poor in easiness in use.

Further, since the conventional cylinder lock with the variable key code requires many complicated components and therefore is complicated in mechanism for changing the key code, it is not possible to produce the conventional cylinder lock with the variable key code at low cost

SUMMARY OF THE INVENTION

Under such circumstances, the present invention was made to solve the problems inherent in the prior art.

Consequently, it is an object of the present invention to provide a side bar type cylinder lock with a variable key code. The cylinder lock of the present invention is provided with a plug. The plug is provided with only one keyhole in its front surface. Due to this, the cylinder lock of the present invention is excellent in appearance and may discourage tampering of its keyhole. Further, the cylinder lock of the present invention is excellent in easiness in use when its key code is changed. Still further, the cylinder lock of the present invention is simple in construction since it does not require a reset key nor a retractor, wherein both the reset key and the retractor are essential components of the conventional cylinder lock capable of changing its key code. Due to this simple construction, it is possible to produce the cylinder lock of the present invention at low cost.

It is another object of the present invention to provide a side bar type cylinder lock with a variable key code, wherein: the cylinder lock of the present invention is provided with a plug and a sleeve-like casing; the plug is rotatably, but not axially slidably, mounted in the sleeve-like casing; and, the plug has its two engaging projections detachably engaged with the sleeve-like casing.

In accordance with a first aspect of the present invention, the above object of the present invention is accomplished by providing:

A side bar type cylinder lock with a variable key code comprising:

a sleeve-like casing (1) provided with both a side bar holder engaging concave portion (2) and a side bar engaging concave portion (5) in an inner peripheral surface of the casing (1);

a plug (6) rotatably, but not axially slidably, mounted in the sleeve-like casing (1), wherein the plug (6) is provided with: a keyhole (7) which opens into a front surface of the plug (6) to axially extend in the plug (6); a plurality of tumbler insertion holes (8) each intersecting the keyhole (7) of the plug (6); a side bar holder receiving hole (9) formed in one of opposite sides of the tumbler insertion holes (8); and, a spring receiving hole (10) formed in the other of the opposite sides of the tumbler insertion holes (8);

a plurality of tumbler plates (11) each slidably mounted in one of the tumbler insertion holes (8) of the plug (6), wherein: the tumbler plate (11) has one of its opposite side surfaces formed into a side end portion (26) provided with a side bar engaging concave portion (12); and, the tumbler plate (11) has the other of the opposite side surfaces formed into an engaging portion (13);

a plurality of variable tumblers (14) each slidably mounted in one of the tumbler insertion hole (8) of the plug (6), wherein the variable tumbler (14) has one of its opposite side surfaces formed into a saw-toothed engaged portion (15) capable of detachably engaging with the engaging portion (13) of the tumbler plate (11), wherein the variable tumbler (14) has its central portion provided with a key passing hole (17) communicating with the keyhole (7);

a spring (18) received in the spring receiving hole (10) of the plug (6) to resiliently bias the variable tumbler (14) toward the inner peripheral surface of the sleeve-like casing (1);

a side bar holder (19) slidably mounted in the side bar holder receiving hole (9) of the plug (6), wherein: the side bar holder (19) has one of its opposite side surfaces bulged outwardly and formed the thus bulged surface into a bulged portion (21) and has its central portion provided with a side bar receiving hole (20); and, when the plug (6) is rotatably driven relative to the sleeve-like casing (1), the bulged portion (21) enters the side bar holder engaging concave hole (2) of the sleeve-like casing (1) to engage with the side bar holder engaging concave hole (2);

a side bar (22) slidably mounted in the side bar receiving hole (20) of the side bar holder (19), wherein: the side bar (22) has its front end portion (23) biased in a biasing direction toward the side bar engaging concave portion (5) of the sleeve-like casing (1) so as to engage therewith; and, when the plug (6) is rotatably driven relative to the sleeve-like casing (1), the side bar (22) is moved in a direction opposite to the biasing direction of the side bar (22) to have its proximal end portion (24) engaged with the side bar engaging concave portion (12) of the tumbler plate (11); and a spring (25) for biasing the tumbler plate (11) toward the side bar holder (19), wherein: when the plug (6) is rotatably driven relative to the sleeve-like casing (1) to have the bulged portion (21) of the side bar holder (19) oppositely disposed from the side bar holder engaging concave portion (2) of the sleeve-like casing (1), the spring (25) resiliently forces the side end portion (26) of the tumbler plate (11) to enter the side bar holder receiving hole (9) of the plug (6), and resiliently forces the bulged portion (21) of the side bar holder (19) to enter the side bar holder engaging concave portion (2) of the sleeve-like casing (1), and further resiliently forces the engaging portion (13) of the tumbler plate (11) to disengage from the engaged portion (15) of the variable tumbler (14).

In the side bar type cylinder lock having the above construction, preferably: the sleeve-like casing (1) is provided with two variable-tumbler engaging concave portions (3, 4) in its inner peripheral surface; the variable tumbler (14) has one of its end portions formed into a locking projection (16); and, when the front end portion (23) of the side bar (22) is engaged with the side bar engaging concave portion (5) of the sleeve-like casing (1) and the proximal end portion (24) of the side bar (22) abuts against the side end portion (26) of the tumbler plate (11), the locking projection (16) of the variable tumbler (14) is engaged with the variable-tumbler engaging concave portion (3) of the sleeve-like casing (1).

BRIEF DESCRIPTION OF THE DRAWINGS

The above and other objects, advantages and features of the present invention will be more apparent from the following description taken in conjunction with the accompanying drawings in which.

DETAILED DESCRIPTION OF THE PREFERRED EMBODIMENTS

The best modes for carrying out the present invention will be described in detail using embodiments of the present invention with reference to the accompanying drawings.

Figure 1:
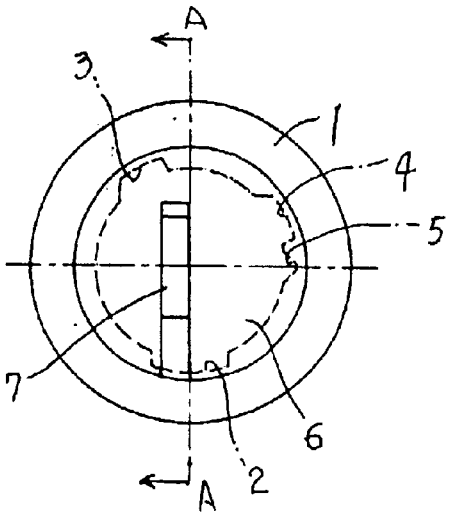
FIG. 1 is a front view of an embodiment of a side bar type cylinder lock with a variable key code according to the present invention.
Figure 2:
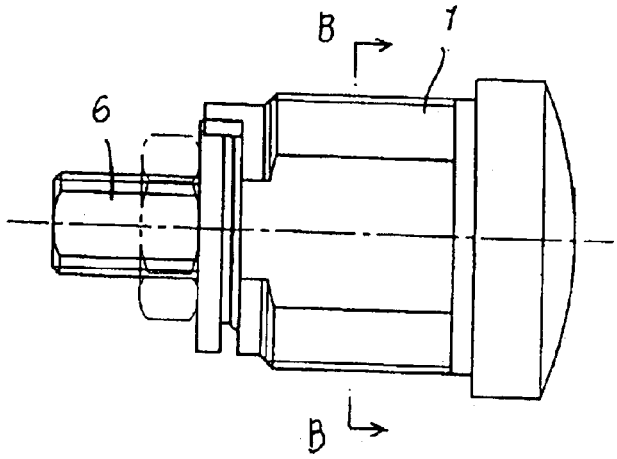
FIG. 2 is a left side view of the cylinder lock of the present invention shown in FIG. 1.

A side bar type cylinder lock of the present invention is provided with a variable key code. In construction, as shown in FIG. 1, the cylinder lock of the present invention is provided with a sleeve-like casing 1. This casing 1 is provided with both a side bar holder engaging concave portion 2 and a side bar engaging concave portion 5 in an inner peripheral surface of the casing 1.

Figure 4:
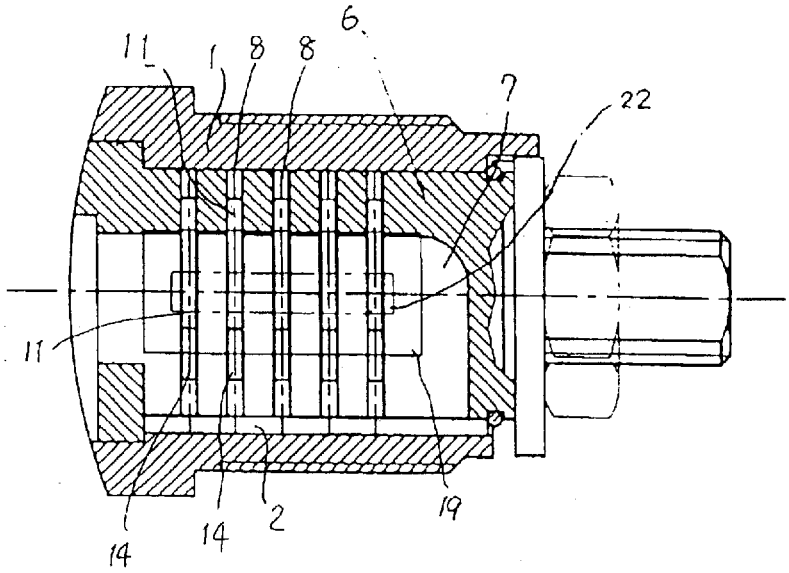
FIG. 4 is a longitudinal sectional view of the cylinder lock of the present invention, taken along the line A—A of FIG. 1.
Figure 5:
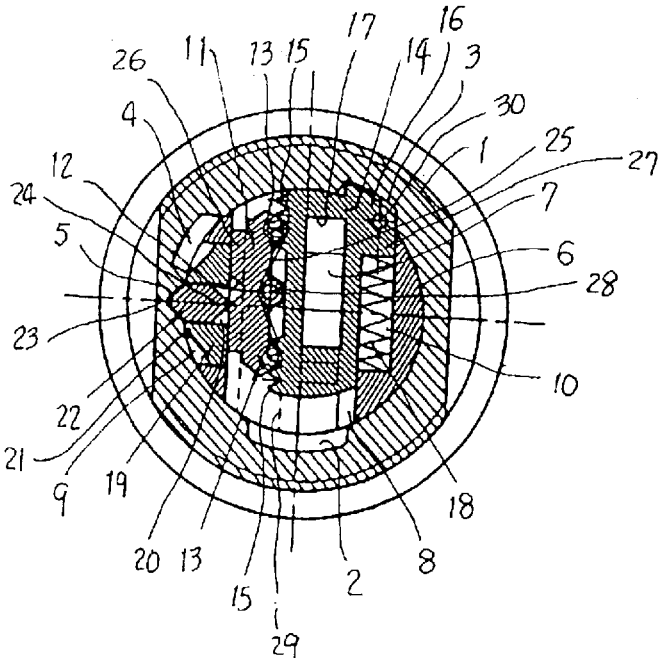
FIG. 5 is a cross-sectional view of the cylinder lock of the present invention, taken along the line B—B of FIG. 2.
Figure 6:
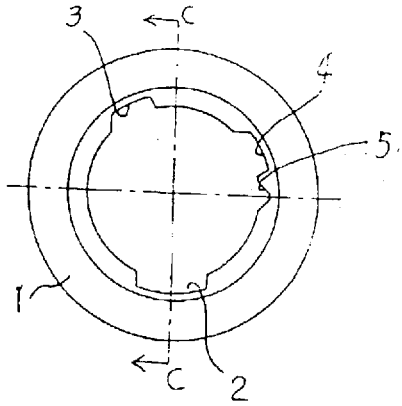
FIG. 6 is a front view of a casing used in the cylinder lock of the present invention shown in FIG. 1.
Figure 7:
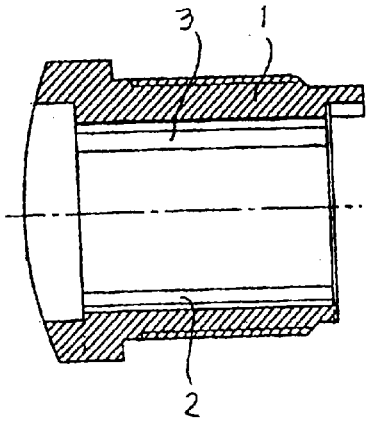
FIG. 7 is a longitudinal sectional view of the casing of the cylinder lock of the present invention, taken along the line C—C of FIG. 6.

As shown in FIG. 5, a plug 6 is rotatably, but not axially slidably, mounted in the sleeve-like casing 1. As is clear from FIGS. 4 and 5, the plug 6 is provided with: a keyhole 7 which opens into a front surface of the plug 6 to axially extend in the plug 6; a plurality of tumbler insertion holes 8 each intersecting the keyhole 7 of the plug 6; a side bar holder receiving hole 9 formed in one of two opposite sides of each of the tumbler insertion holes 8; and, a spring receiving hole 10 formed in the other of the two opposite sides of each of the tumbler insertion holes 8.

Further, as is clear from FIGS. 4 and 5, the cylinder lock of the present invention is provided with a plurality of tumbler plates 11 each slidably mounted in one of the tumbler insertion hole 8 of the plug 6, wherein: each of the tumbler plates 11 has one of its two opposite side surfaces formed into a side end portion 26 provided with a side bar engaging concave portion 12, while each tumbler plate 11 has the other of the opposite side surfaces formed into an engaging portion 13.

Also, as is clear from FIGS. 4 and 5, the cylinder lock of the present invention is provided with a plurality of variable tumblers 14 each slidably mounted in the tumbler insertion holes 8 of the plug 6, wherein: the variable tumbler 14 has one of its opposite side surfaces formed into a saw-toothed engaged portion 15 capable of detachably engaging with the engaging portion 13 of the tumbler plate 11; and, each variable tumbler 14 has its central portion provided with a key passing hole 17 communicating with the keyhole 7.

As shown in FIG. 5, a spring 18 is received in the spring receiving hole 10 of the plug 6 to resiliently bias the variable tumbler 14 toward the inner peripheral surface of the sleeve-like casing 1.

Figure 13:
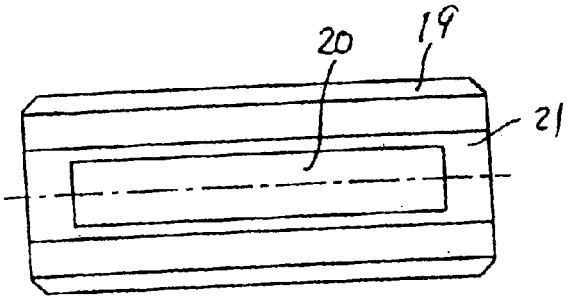
FIG. 13 is a front view of a side bar holder used in the cylinder lock of the present invention shown in FIG. 1.

On the other hand, as is clear from FIG. 5, a side bar holder 19 is slidably mounted in the side bar holder receiving hole 9 of the plug 6. As shown in FIG. 5, the side bar holder 19 has one of its opposite surfaces bulged outwardly and formed the thus bulged surface into a bulged portion 21 and has its central portion provided with a side bar receiving hole 20 shown in FIG. 13. When the plug 6 is rotatably driven relative to the sleeve-like casing 1, the bulged portion 21 of the side bar holder 19 enters the side bar holder engaging concave hole 2 of the sleeve-like casing 1 to engage with the side bar holder engaging concave hole 2.

Figure 14:
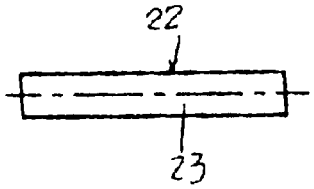
FIG. 14 is a right side plan view of the side bar holder shown in FIG. 13.

As is clear from FIG. 5, a side bar 22 (shown in FIG. 14) is slidably mounted in the side bar receiving hole 20 of the side bar holder 19. More specifically, the side bar 22 has its front end portion 23 biased in a biasing direction toward the side bar engaging concave portion 5 of the sleeve-like casing 1 so as to engage therewith. When the plug 6 is rotatably driven relative to the sleeve-like casing 1, the side bar 22 is moved in a direction opposite to the above-mentioned biasing direction of the side bar 22 to have its proximal end portion 24 engaged with the side bar engaging concave portion 12 of the tumbler plate 11.

Further, as shown in FIG. 5, the cylinder lock of the present invention is provided with a spring 25 (shown in FIG. 19) for biasing the tumbler plate 11 toward the side bar holder 19. When the plug 6 is rotatably driven relative to the sleeve-like casing 1 to have the bulged portion 21 of the side bar holder 19 oppositely disposed from the side bar holder engaging concave portion 2 of the sleeve-like casing 1, the spring 25 resiliently forces the side end portion 26 of the tumbler plate 11 to enter the side bar holder receiving hole 9 of the plug 6, and resiliently forces the bulged portion 21 of the side bar holder 19 to enter the side bar holder engaging concave portion 2 of the sleeve-like casing 1, and further resiliently forces the engaging portion 13 of the tumbler plate 11 to disengage from the engaged portion 15 of the variable tumbler 14.

In the side bar type cylinder lock having the above construction, preferably, the sleeve-like casing 1 is provided with both a variable-tumbler engaging concave portion 3, 4 in its inner peripheral surface. The variable tumbler 14 has one of its end portions formed into a locking projection 16. When the front end portion 23 of the side bar 22 is engaged with the side bar engaging concave portion 5 of the sleeve-like casing 1 and the proximal end portion 24 of the side bar 22 abuts against the side end portion 26 of the tumbler plate 11, the locking projection 16 of the variable tumbler 14 is engaged with the variable-tumbler engaging concave portion 3 of the sleeve-like casing 1 to lock the cylinder lock of the present invention, as shown in FIG. 5.

As is clear from FIG. 5, in this locked condition of the cylinder lock of the present invention, the locking projection 16 of the variable tumbler 14 is inserted into the variable-tumbler engaging concave portion 3 of the sleeve-like casing 1, and held therein under the influence of a resilient force exerted by the spring 18. On the other hand, in this locked condition, the side bar holder 19 is received in the side bar holder receiving hole 9 of the plug 6. As is clear from FIG. 5, slidably mounted in this side bar holder 19 is the side bar 22. In the locked condition, the side bar 22 has its front end portion 23 engaged with the side bar engaging concave portion 5 of the sleeve-like casing 1, and has its proximal end portion 24 abutted against the side end portion 26 of the tumbler plate 11, so that the side bar 22 is held in its locked position shown in FIG. 5. On the other hand, in the locked condition, the tumbler plate 11 is positioned in the closest vicinity to the variable tumbler 14 to have its engaging portion 13 meshed with the saw-toothed engaged portion 15 of the variable tumbler 14.

In order to unlock the cylinder lock of the present invention by rotating the plug 6 in its unlocking direction after the plug 6 is released from engagement with the casing 1, the key K (shown in FIG. 3) corresponding to the current key code is inserted into the keyhole 7 of the cylinder lock.

Figure 3:
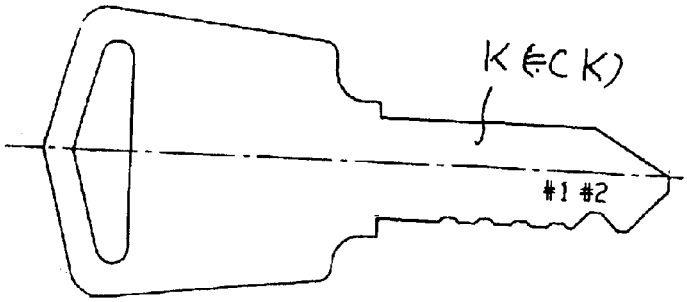
FIG. 3 is a right side view of a key used in the cylinder lock of the present invention shown in FIG. 1.

As is clear from FIG. 3, the key K is provided with a key code portion (i.e., "bit portion #1, 190 2") formed in an edge portion of the key K. When the key K is inserted into the keyhole 7 of the cylinder lock, the key code portion #1, #2" of the key pushes an inner end surface of the key passing hole 17 of each of the variable tumblers 14, so that each of the variable tumblers 14 and each of the tumbler plates 11 each meshed with the corresponding variable tumbler 14 are integrally, slidably and radially moved, whereby the locking projection 16 of each of the variable tumblers 14 is disengaged from the variable-tumbler engaging concave portion 3 of the sleeve-like casing 1.

In this stage, the side bar engaging concave portion 12 of the tumbler plate 11 is moved to a position in which the side bar engaging concave portion 12 is oppositely disposed from a rear end portion 24 of the side bar 22. Under such circumstances, when the plug 6 is rotatably driven counter-clockwise by the key K as viewed in FIG. 5, the front end portion 23 of the side bar 22 forces its oblique cam surface slide to slide on the corresponding oblique cam surface of the side bar engaging concave portion 5 of the casing 1 so that the side bar 22 is disengaged from the casing 1, while the rear end portion 24 of the side bar 22 enters the side bar engaging concave portion 12 of the tumbler plate 11 and is engaged with the tumbler plate 11.

The plug 6 is rotatably driven through a predetermined angle so as to move the side bar holder 19 to a position immediately before a key change position where the side bar holder 19 is oppositely disposed from the side bar holder engaging concave portion 2 of the casing 1. As a result, the plug 6 reaches an unlocking position thereof.

In the case where the current key code of the cylinder lock of the present invention should be changed as a result of the loss or theft of the key K, it is necessary to insert a change key CK into the keyhole 7.

When the change key CK is inserted into the keyhole 7, the key code portion of the change key CK pushes the inner end surface of the key passing groove 17 of each of the variable tumblers 14, so that each of the variable tumblers 14 and each of the corresponding tumbler plates 11 are integrally and slidably moved, whereby the locking projection 16 of each of the variable tumblers 14 is disengaged from the corresponding variable tumbler engaging concave portions 3 of the casing 1 to permit the plug 6 rotates relative to the casing 1.

Under such circumstances, the plug 6 is further rotatably driven to reach a key change position of the cylinder lock. In this key change position, the side end portion 26 of the tumbler plate 11 enters the side bar holder receiving hole 9 of the plug 6 under the influence of a resilient force exerted by the spring 25 to push the side bar holder 19 leftward, as viewed in FIG. 5. As a result, the side bar holder 19 thus pushed leftward has its bulged portion 21 enter the side bar holder engaging concave portion 2 of the casing 1. Due to this, the tumbler plate 11 is moved away from the variable tumbler 14 to have its engaging portion 13 completely disengaged from the saw-toothed engaged portion 15 of the variable tumbler 14.

After that, the change key CK is moved back and forth in a longitudinal direction of the tumbler insertion hole 8 of the plug 6 (i.e., in a direction perpendicular to a longitudinal direction of the plug 6), so that each of the variable tumblers 14 is forcibly moved. At this time, each of the tumbler plates 11 has its side end portion 26 engaged with the side bar holder receiving hole 9 of the plug 6 and is therefore kept in its fixed position, while each of the variable tumblers 14 is moved relative to each of the tumbler plates thus kept stationary in the fixed position thereof. This enables the change key CK to change the key code of the cylinder lock of the present invention from the current key code to a new key code.

After that, the change key CK is removed from the keyhole 7 of the cylinder lock. Then, a new key K having the new key code is inserted into the keyhole 7 and rotated clockwise as viewed in FIG. 5, so that a side surface of the bulged portion 21 of the side bar holder 19 is pushed back into the side bar holder receiving hole 9 of the plug 6, whereby the side surface end portion 26 of each of the tumbler plates 11 is pushed out of the side bar holder receiving hole 9 of the plug 6. This permits each of the tumbler plates 11 to move to each of the corresponding variable tumblers 14, so that the engaging portion 13 of each tumbler plate 11 is engaged with the saw-toothed engaged portion 15 of each of the corresponding variable tumblers 14 in another engagement area of each saw-toothed engaged portion 15, which another engagement area is different from the previous engagement area of the saw-toothed engaged portion 15 of each variable tumbler 14 with respect to the engaging portion 13 of each tumbler plate 11.

Figure 15:
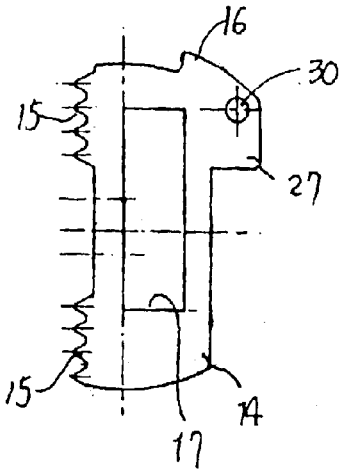
FIG. 15 is an enlarged front view of the variable tumbler used in the cylinder lock of the present invention shown in FIG. 1.
Figure 17:
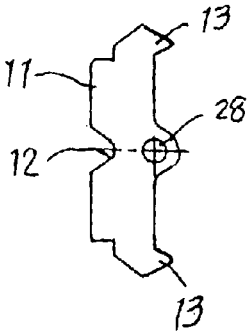
FIG. 17 is an enlarged front view of the tumbler plate used in the cylinder lock of the present invention shown, in FIG. 1.
Figure 18:
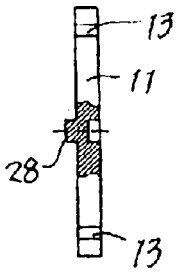
FIG. 18 is a right side view of the tumbler plate shown in FIG. 17.

In the embodiment of the cylinder lock of the present invention, as shown in FIGS. 5 and 15, the variable tumbler 14 is provided with a spring support portion 27 in its side portion opposite to the saw-toothed engaged portion 15 thereof. The spring 18 for biasing the variable tumbler 14 is constructed of a compression coil spring. As is clear from FIG. 5, the spring 18 is compressed and mounted between the spring receiving hole 10 of the plug 6 and the spring support portion 27 of the variable tumbler 14. As shown in FIG. 17, the tumbler plate 11 is provided with a pair of the engaging portions 13 in its opposite ends, between which a spring support member 28 constructed of a pin and the like is fixedly mounted on a rear surface of the tumbler plate to extend in a direction perpendicular to the plane of the tumbler plate 11. Incidentally, the spring support member 28 may be constructed of an embossed portion of the tumbler plate 11.

Figure 19:
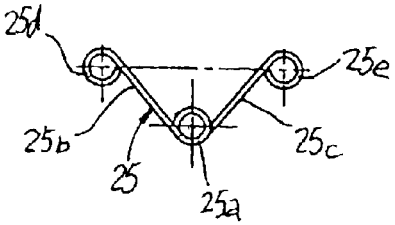
FIG. 19 is an enlarged front view of the spring for biasing the tumbler plate shown in FIG. 18 in cylinder lock of the present invention.

As shown in FIG. 19, the spring 25 for biasing the tumbler plate 11 is constructed of a torsion coil spring comprising: a central coil portion 25*a;* a pair of linear portions 25*b,* 25*c* each extending each of opposite ends of the central coil portion 25*a;* and, a pair of front end curled portions 25*d,* 25*e,* wherein the front end curled portions 25*d* and 25*e* extend from the linear portions 25*b* and 25*c,* respectively. As is clear from FIG. 5, the front end curled portions 25*d,* 25*e* of the spring 25 abut against the side surface of the variable tumbler 14. On the other hand, as for the spring 25, a distance between: a line passing through a center of each of the front end curled portions 25*d,* 25*e* of the spring 25; and, a line passing through a center of the coil portion 25*a* of the spring varies when the tumbler plate 11 is moved to and away from the variable tumbler 14.

Figure 9:
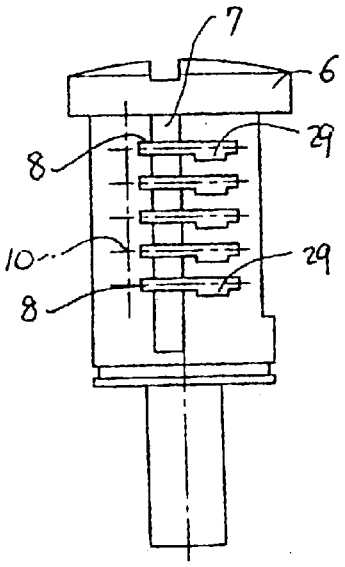
FIG. 9 is a plan view of the plug shown in FIG. 8.
Figure 11:
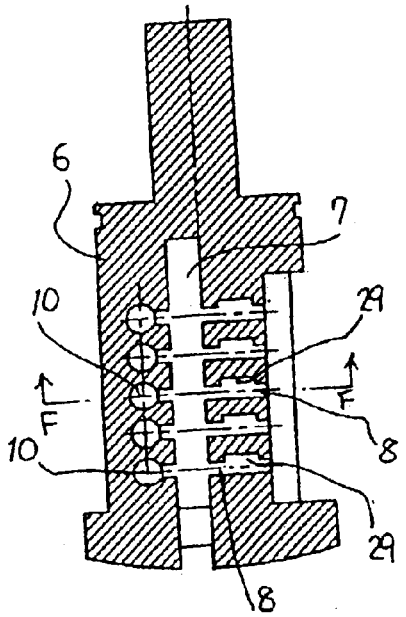
FIG. 11 is a longitudinal sectional view of the plug, taken along the line E—E of FIG. 8.
Figure 12:
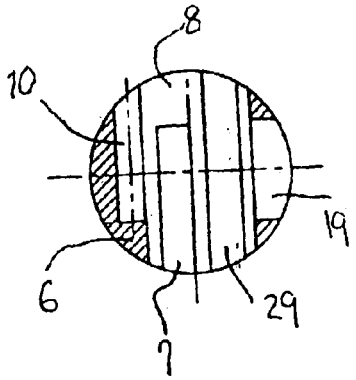
FIG. 12 is a cross-sectional view of the plug, taken along the line F—F of FIG. 11.

As is clear from FIGS. 9, 11 and 12, both the spring 25 for biasing the tumbler plate 11 and the spring support member 28 are received in a recessed groove portion 29, which is formed in one of opposite radially extending inner wall surfaces of each of the tumbler insertion holes 8 of the plug 6.

Figure 8:
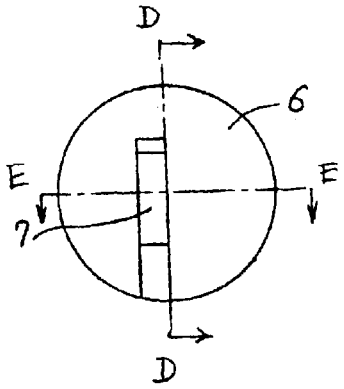
FIG. 8 is a front view of a plug used in the cylinder lock of the present invention shown in FIG. 1.
Figure 10:
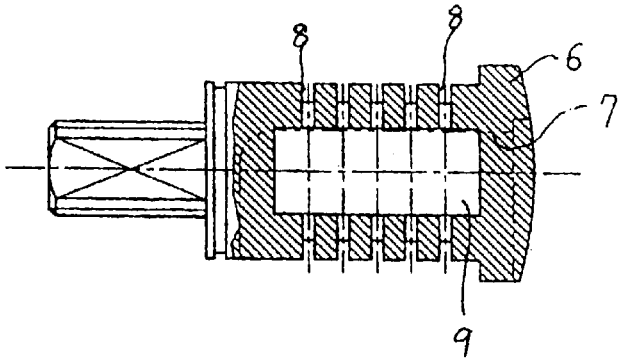
FIG. 10 is a longitudinal sectional view of the plug, taken along the line D—D of FIG. 8.
Figure 16:
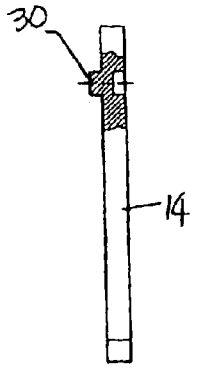
FIG. 16 is a left side view of the variable tumbler shown in FIG. 15.

As shown in FIGS. 8 and 10, in the above arrangement, the keyhole 7 is radially offset with respect to a center of the plug 6. As is suggested in FIG. 13, the bulged portion 21 of the side bar holder 19 has a low mountain-like profile. On the other hand, as is suggested in FIG. 14, the side bar 22 has a hexagonal shape in cross section, and has each of the front end portion 23 and the rear end portion 24 thereof formed into a mountain-like shape. As shown in FIG. 16. a guide projection 30 is formed in a rear surface of the spring support portion 27 of the variable tumbler 14. In operation, when the variable tumbler 14 slidably moves in a direction perpendicular to the longitudinal direction of the plug 6, the guide projection 30 moves in the spring receiving hole 10.

In the same manner as that of the prior art, a rotation angle control plate and a fastening plate are fixedly mounted on a rear end portion of the plug 6.

The effect of the present invention is as follows:

In the side bar type cylinder lock of the present invention provided with the variable key code, when the user wants to change the current key code to a new one, it is necessary for the user to insert a new change key C into the keyhole 7 and rotate the plug 6 in a manner such that the bulged portion 21 of the side bar holder 19 is oppositely disposed from the side bar holder engaging concave portion 2 of the casing 1. When the bulged portion 21 of the side bar holder 19 is oppositely disposed from the side bar holder engaging concave portion 2 of the casing 1, the side surface portion 26 of the tumbler plate 11 enters the side bar holder receiving hole 9 of the plug 6 under the influence of a resilient force exerted by the spring 25. This causes the bulged portion 21 of the side bar holder 19 to enter the side bar holder engaging concave portion 2 of the casing 1, so that the engaging portions 13 of the tumbler plate 11 are disengaged from the saw-toothed engaged portions 15 of the variable tumbler 14. After such disengagement of the engaging portions 13 from the saw-toothed engaged portions 15 the variable tumbler 14, the variable tumbler 14 should be rotated through a predetermined angle. After that, the engaging portions 13 of the tumbler plate 11 are engaged again with the saw-toothed engaged portions 15 of the variable tumbler 14 so that the key code of the cylinder lock of the present invention is changed from the previous key code to a new key code. Consequently, it is possible for the cylinder lock of the present invention to change the key code in an easy manner as described above. Further, in contrast with the conventional cylinder lock capable of changing its key code, the cylinder lock of the present invention, which is also capable of changing its key code, does not require any reset key and any retractor both of which are essential components of the conventional cylinder lock. This enables the cylinder lock of the present invention to reduce the number of its components. Therefore, it is possible of the cylinder lock of the present invention to realize a considerable cost reduction and to simplified in mechanisms for changing the key code.

Further, the cylinder lock of the present invention is provided with only one aperture (i.e., keyhole 7) in the front surface of the plug 6. Due to this, the cylinder lock of the present invention is improved also in appearance and in resistance to attack.

In a preferable modification of the above embodiment of the cylinder lock of the present invention capable of changing the key code: the tumbler plate 11 and the variable tumbler 14 are combined in a manner such that the engaging portion 13 of the tumbler plate 11 is engaged with the engaged portion 15 of the variable tumbler 14, wherein the tumbler plate 11 and the variable tumbler 14 thus combined with each other are inserted into the tumbler insertion hole 8 of the plug 6; the locking projection 16 of the variable tumbler 14 is engaged with the variable tumbler engaging concave portion 3 of the casing 1; the front end portion 23 of the side bar 22 having been received in the side bar receiving hole 20 of the side bar holder 19 is engaged with the side bar engaging concave portion 5 of the casing 1; and, the proximal end portion 24 of the side bar 22 is brought into abutting-contact with the side surface end portion 26 of the tumbler plate 11. Due to this, it is possible for the cylinder lock of the present invention to lock the plug 6 to the casing 1 in two portions, one of which is the locking projection 16 of the variable tumbler 14 and the other is the side bar 22. This prevents the plug 6 from rotating relative to the casing 1 in the lock state of the cylinder lock of the present invention, without fail. Consequently, it is possible to considerably improve the cylinder lock of the present invention in its locking ability.

Finally, the present application claims the convention priority based on Japanese Patent Application No. 2002-300965 filed on Oct. 15, 2002, which is herein incorporated by reference.

What is claimed is:

1. A side bar type cylinder lock with a variable key code, comprising:

a sleeve-like casing (1) provided with both a side bar holder engaging concave portion (2) and a side bar engaging concave portion (5) in an inner peripheral surface of said casing (1);

a plug (6) rotatably, but not axially slidably, mounted in said sleeve-like casing (1), wherein said plug (6) is provided with: a keyhole (7) which opens into a front surface of said plug (6) to axially extend in said plug (6); a plurality of tumbler insertion holes (8) each intersecting said keyhole (7) of said plug (6); a side bar holder receiving hole (9) formed in one of opposite sides of said tumbler insertion hole (8); and, a spring receiving hole (10) formed in the other of said opposite sides of said tumbler insertion hole (8);

a plurality of tumbler plates (11) each slidably mounted in one of said tumbler insertion holes (8) of said plug (6), wherein: said tumbler plate (11) has two opposite side surfaces and has one of its said two opposite side surfaces formed into a side end portion (26) provided with a side bar engaging concave portion (12); and, said tumbler plate (11) has the other of said two opposite side surfaces formed into an engaging portion (13);

a plurality of variable tumblers (14) each slidably mounted in one of said tumbler insert holes (8) of said plug (6), wherein said variable tumbler (14) has two end portions and two opposite side surfaces and has one of its said two opposite side surfaces formed into a saw-toothed engaged portion (15) capable of detachably engaging with said engaging portion (13) of said tumbler plate (11), wherein said variable tumbler (14) has a central portion provided with a key passing hole (17) communicating with said keyhole (7);

a spring (18) received in said coil spring receiving hole (10) of said plug (6) to resiliently bias said variable tumbler (14) toward said inner peripheral surface of said sleeve-like casing (1);

a side bar holder (19) slidably mounted in said side bar holder receiving hole (9) of said plug (6), wherein: said side bar holder (19) has two opposite side surfaces and has one of its said two opposite side surfaces bulged outwardly and formed the thus bulged surface into a bulged portion (21) and said side bar holder (19) has a central portion provided with a side bar receiving hole (20); and when said plug (6) is rotatably driven relative to said sleeve-like casing (1), said bulged portion (21) enters said side bar holder engaging concave hole (2) of said sleeve-like casing (1) to engage with said side bar holder engaging concave hole (2);

a side bar (22) slidably mounted in said side bar receiving hole (20) of said side bar holder (19), wherein: said side bar (22) has a front end portion (23) biased in a biasing direction toward said side bar engaging concave portion (5) of said sleeve-like casing (1) so as to engage therewith; and, when said plug (6) is rotatably driven relative to said sleeve-like casing (1), said side bar (22) is moved in a direction opposite to said biasing direction of said side bar (22) to have a proximal end portion (24) engaged with said side bar engaging concave portion (12) of said tumbler plate (11); and a torsion spring (25) for biasing said tumbler plate (11) toward said side bar holder (19), wherein: when said plug (6) is rotatably driven relative to said sleeve-like casing (1) to have said bulged portion (21) of said side bar holder (19) oppositely disposed from said side bar holder engaging concave portion (2) of said sleeve-like casing (1), said torsion spring (25) resiliently forces said side end portion (26) of said tumbler plate (11) to enter said side bar holder receiving hole (9) of said plug (6), and resiliently forces said bulged portion (21) of said side bar holder (19) to enter said side bar holder engaging concave portion (2) of said sleeve-like casing (1), and further resiliently forces said engaging portion (13) of said tumbler plate (11) to disengage from said engaged portion (15) of said variable tumbler (14).

2. The side bar type cylinder lock with the variable key code as set forth in claim 1, wherein:

said sleeve-like casing (1) is provided with two variable-tumbler engaging concave portions (3,4) in its inner peripheral surface;

said variable tumbler (14) has one of its said two end portions formed into a locking projection (16); and when said front end portion (23) of said side bar (22) is engaged with said side bar engaging concave portion (5) of said sleeve-like casing (1) and said proximal end portion (24) of said side bar (22) abuts against said side end portion (26) of said tumbler plate (11), said locking projection (16) of said variable tumbler (14) is engaged with said variable-tumbler engaging concave portion (3) of said sleeve-like casing (1).

3. The side bar type cylinder lock with a variable key code as set forth in claim 1, wherein each said tumbler plate (11) includes a spring support member (28) located between said engaging portions (13) of the tumbler plate (11) so that said spring support member (28) is contacted by said torsion spring (25).

4. The side bar type cylinder lock with a variable key code as set forth in claim 1, wherein said variable tumbler (14) is provided with a spring support portion (27) in its said side portion opposite to said saw-toothed engaged portion (15) and said spring support portion (27) is contacted by said coil spring (18), and a guide projection (30) formed in one side of said support portion (27).

5. The side bar type cylinder lock with a variable key code as set forth in claim 1, wherein said torsion spring (25) is a torsion coil spring having a central coil portion (25*a*) and a pair of linear portions (25*b*, 25*c*) each extending in an opposite direction from the central coil portion (25*a*).

* * * * *